US007683017B2

(12) United States Patent
Cherpeck et al.

(10) Patent No.: US 7,683,017 B2
(45) Date of Patent: Mar. 23, 2010

(54) SYNERGISTIC LUBRICATING OIL COMPOSITION CONTAINING A MIXTURE OF A NITRO-SUBSTITUTED DIARYLAMINE AND A DIARYLAMINE

(75) Inventors: Richard E. Cherpeck, Cotati, CA (US); Carrie Y. Chan, Daly City, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 228 days.

(21) Appl. No.: 11/766,070

(22) Filed: Jun. 20, 2007

(65) Prior Publication Data

US 2008/0318815 A1 Dec. 25, 2008

(51) Int. Cl.
*C10M 133/32* (2006.01)
*C10M 133/12* (2006.01)
*C09K 15/20* (2006.01)

(52) U.S. Cl. ..... 508/549; 508/362; 508/375; 508/433; 508/557; 508/563; 252/401; 252/403

(58) Field of Classification Search ..... 508/290, 508/244, 268, 433, 547, 549; 252/397, 398, 252/399, 400, 401, 402, 403
See application file for complete search history.

(56) References Cited

U.S. PATENT DOCUMENTS

| | | | | |
|---|---|---|---|---|
| 1,896,461 | A | 2/1933 | Muth | |
| 2,342,135 | A | 2/1944 | Gibbs | |
| 2,718,501 | A | 9/1955 | Harle | |
| 2,794,020 | A | 5/1957 | Harris et al. | |
| 2,943,112 | A | 6/1960 | Popoff et al. | |
| 2,958,663 | A | 11/1960 | Westcott et al. | |
| 2,998,468 | A | 8/1961 | Wilde | |
| 3,345,992 | A | 10/1967 | Lederman et al. | |
| 3,362,929 | A * | 1/1968 | Kehe | 524/87 |
| 3,452,056 | A | 6/1969 | Sundholm | |
| 3,480,635 | A | 11/1969 | Altwicker | |
| 3,505,225 | A | 4/1970 | Wheeler | |
| 3,533,992 | A | 10/1970 | Sundholm | |
| 3,655,559 | A | 4/1972 | Holt | |
| 3,660,290 | A | 5/1972 | Schlobohm | |
| 3,855,281 | A * | 12/1974 | Sullivan et al. | 560/4 |
| 3,910,918 | A | 10/1975 | Monroy | |
| 3,944,492 | A | 3/1976 | Wheeler | |
| 4,021,486 | A | 5/1977 | Halasz et al. | |
| 4,069,195 | A | 1/1978 | Layer et al. | |
| 4,089,792 | A | 5/1978 | Lowe | |
| 4,155,936 | A * | 5/1979 | Sturm | 564/406 |
| 4,394,279 | A | 7/1983 | deVries et al. | |
| 4,463,191 | A | 7/1984 | D'Sidocky et al. | |
| 4,692,258 | A | 9/1987 | Rasberger et al. | |
| 4,965,006 | A | 10/1990 | Meier et al. | |
| 5,117,063 | A | 5/1992 | Stern et al. | |
| 5,198,134 | A | 3/1993 | Steinberg et al. | |
| 5,232,614 | A | 8/1993 | Colclough et al. | |
| 5,310,491 | A | 5/1994 | Downs et al. | |
| 5,420,354 | A | 5/1995 | Malz et al. | |
| 5,451,702 | A | 9/1995 | Stern et al. | |
| 5,595,963 | A | 1/1997 | Puckace et al. | |
| 5,834,544 | A | 11/1998 | Lin et al. | |
| 5,840,982 | A | 11/1998 | Reynolds et al. | |
| 5,994,277 | A * | 11/1999 | Ritchie et al. | 508/365 |
| 6,121,209 | A | 9/2000 | Watts et al. | |
| 6,174,842 | B1 | 1/2001 | Gatto et al. | |
| 6,315,925 | B1 | 11/2001 | Aebli et al. | |
| 6,388,136 | B1 | 5/2002 | Beska et al. | |
| 6,426,324 | B1 | 7/2002 | Lai et al. | |
| 6,685,823 | B2 | 2/2004 | Benage et al. | |
| 6,726,855 | B1 * | 4/2004 | Migdal et al. | 252/401 |
| 6,806,241 | B2 | 10/2004 | Karol et al. | |
| 7,183,439 | B2 | 2/2007 | Triplett, II et al. | |
| 2006/0094607 | A1 | 5/2006 | Devlin et al. | |
| 2007/0123586 | A1 | 5/2007 | Lardy et al. | |

FOREIGN PATENT DOCUMENTS

| | | | |
|---|---|---|---|
| EP | 1 326 943 | B1 | 1/2006 |
| WO | WO 2005/051888 | A3 | 6/2005 |

OTHER PUBLICATIONS

A Study of the Association of Secondary Aromatic Amines Via their Infrared and NMR Spectrosocpy by Koshkin, L.V., Rodionova, N.M., Yablonskii, O.P. and Chekalova, E.G. (Translated from Zhurnal Prikladnol Spektroskipii, vol. 25, No. 2 pp. 352-355 Aug. 1976).*

McQueen, J.S. et al., Friction and wear of tribofilms formed by zinc dialkyl dithiophosphate antiwear additive in low viscosity engine oils, Elsevier Science Ltd., Tribology International 38, (2005), pp. 289-297.

Ingold, K.U., Inhibition of the Autoxidation of Organic Substances in the Liquid Phase, Division of Applied Chemistry, National Research Council Publication No. 6537, American Chemical Society, Chemical Reviews, vol. 61, (1961), pp. 563-589.

Nishiyama, Tomihiro et al., Antioxidant activity of the fused heterocyclic compounds, 1,2,3,4-tetrahydroquinolines, and related compounds—effect of *ortho*-substituents, Elsevier Science Ltd., Polymer Degradation and Stability 79, (2003), pp. 225-230.

Dorey, Gilbert et al., New Quinolinic Derivatives as Centrally Active Antioxidants, Elsevier Science Ltd., Bioorganic & Medicinal Chemistry Letters 10, (2000), pp. 935-939.

Denisov, Evgeniy T. et al., Mechanisms of Action and Reactivities of the Free Radicals of inhibitors, American Chemical Society, Chemical Reviews, vol. 87, No. 6 (1987), pp. 1313-1357.

Nishiyama, Tomihiro et al., Antioxidant activity of aromatic cyclic amine derivatives, Elsevier Science Ltd., Polymer Degradation and Stability 75, (2002), pp. 549-554.

(Continued)

*Primary Examiner*—Ellen M McAvoy
*Assistant Examiner*—Pamela Weiss
(74) *Attorney, Agent, or Firm*—Joseph P. Foley; Claude J. Caroli

(57) ABSTRACT

Disclosed is a lubricating oil composition containing an oil of lubricating viscosity and a particularly effective mixture of a nitro-substituted diphenylamine and a diarylamine which together provide superior oxidation inhibition.

24 Claims, No Drawings

OTHER PUBLICATIONS

Shilov et al., Inhibition of Polyethylene and Polypropylene Oxidation by Nitro Compounds Reacting with Alkyl and Peroxy Radicals, Kinetics and Catalysis, vol. 42, No. 2 (2001), pp. 238-242.

Norris, Polynitrobenzenes with 2-Cyano-2-propyl Radicals, J. Am. Chem. Soc., 1959, vol. 82, No. 16, pp. 4239-4243.

Antioxidative effectiveness of secondary aromatic amines in the oxidation of SKS 30 ARK rubber. Koshkin, L.V.; Rodionova, N.M.; Zyuzina, L.N.; Yablonski, O.P. Yaroslav. Politekh. Inst., Yaroslavl, USSR. Izvestiya Vysshikh Uchebnykh Zavedenii, Khimiya I Khimicheskaya Tekhnologiya (1985), 28(8), 97-100. CODEN: IVUKAR ISSN: 0579-2991, Journal written inRussian. CAN 104:20534 AN 1986:20534 CAPLUS (Copyright 2005 ACS on SciFinder (R)).

Berger, H.; Bolsman, T.A.B.M.; and Brouwer, D.M., "Catalytic Inhibition of Hydrocarbon Autoxidation by Secondary Amines and Nitroxyls", Developments in Polymer Stabilisation—6, 1983, pp. 1-27, Elsevier Applied Science Publishers, London.

Pankratov, A.N. and Shchavlev, A.E., "Protolytic, Redox, and Polar Properties of Diphenylamine and Related Reagents: Quantum-Chemical Evaluation", Journal of Analytical Chemistry, 2001, pp. 123-130, vol. 56, No. 2.

* cited by examiner

SYNERGISTIC LUBRICATING OIL COMPOSITION CONTAINING A MIXTURE OF A NITRO-SUBSTITUTED DIARYLAMINE AND A DIARYLAMINE

FIELD OF THE INVENTION

The present invention is directed in part to a lubricating oil composition containing an oil of lubricating viscosity and a particularly effective mixture of a nitro-substituted diarylamine and a diarylamine which together provide superior oxidation inhibition.

BACKGROUND OF THE INVENTION

Diarylamine antioxidants are known and have been widely used to improve the thermal-oxidative stability and/or light induced degradation in numerous products used in engineering; for example, they can improve the performance properties in lubricants, hydraulic fluids, metal working fluids, fuels or polymers, just to name a few.

Commonly, these diarylamines have been alkylated, see for example, U.S. Pat. No. 2,943,112 which discloses an improved process for alkylating diphenylamine and U.S. Pat. No. 3,655,559 which discloses alkylated diphenylamines as stabilizers. Alkaryl substituted diphenylamines and phenylnapthylamines (such as α-methylstyryl-diphenylamine) are disclosed for example in U.S. Pat. Nos. 3,533,992; 3,452,056 and 3,660,290. Electron withdrawing groups attached to one or more of the phenyl rings has been found to diminish or completely destroy the inhibition ability of the base diphenylamine. Berger et al. *Inhibition of Hydrocarbon Autoxidation*, Developments in Polymer Stabilization-6, Elsevier Applied Science Publishers, 1983, pp 1-27, demonstrated that in a paraffinic oil (Shell Ondina 33, a mixture of high-boiling cycloalkanes and isoalkanes) at 130° C. the addition of nitro groups to a diphenylamine (inhibition coefficient of forty-one) completely destroyed the catalytic activity with a resulting inhibition coefficient to zero for 4-nitro-diphenylamine and bis-(4-nitro)-phenyl-amine. The authors explained that the unpaired electron density in the diarylnitroxyls was strongly de-localized as shown by electron spin resonance spectroscopic studies, and that as a result radical reaction would occur at the nitroxyl function but also undesirably at the aromatic rings. The authors concluded that under conditions of auto-oxidation the intermediate nitroxyl would he attacked by peroxyl radicals on the aromatic ring, eventually resulting in destruction of the inhibitor.

Additionally, alkyl substituted 1,2-dihydroquinoline and polymers thereof, have been employed as antioxidants, see U.S. Pat. Nos. 3,910,918. While, U.S. Pat. No. 5,310,491 discloses the reaction product of an alkyl substituted 1,2-dihydroquinoline with a diarylamine. Tetrahydroquinones and substituted tetrahydroquinones have also have also been disclosed as antioxidants, see for example U.S. Pat. Nos. 2,794,020; 3,362,929; 4,692,258 and 4,965,006; while U.S. Pat. No. 4,848,741 discloses certain N-substituted tetrahydroquinolines. Likewise decahydroquinolines and substituted decahydroquinolines have been employed as antioxidants, see U.S. Pat. Nos. 2,998,468 and 4,069,195.

Synergist and antagonist combinations of antioxidants have been disclosed. Effective synergistic mixtures of antioxidants are typically compounds that intercept oxidation by two different mechanisms. For example, those in which one compounds functions as decomposer of peroxides and the other compound functions as an inhibitor of free radicals. Well known heterosynergism has been disclosed between sulfur and phosphorous containing compounds (such as sulfides, dithiocarbamates, phosphites and dithiophosphates) and aminic or phenolic antioxidants. U.S. Pat. No. 2,718,501 discloses a synergistic mixture of a sulfur-containing compound, such as a wax sulfide or dioctadecyl disulfide, and an aromatic amine compound having at least 2 aromatic rings, such as phenyl alpha-naphthyl amine, for use in preventing oxidation in lubricating oils. For example, U.S. Pat. No. 2,958,663 discloses an extreme pressure lubricant composition containing from 0.01 to 5 percent each of sulforized oleic acid, $C_{18}$-$C_{22}$ alkenyl succinic acid, chlorinated paraffin wax containing from 20 to 60 percent chlorine, diphenylamine and N,N-salicylal-1,2-propylenediamine. U.S. Pat. No. 3,345,292 discloses stabilized alkyl substituted diaryl sulfides for use as functional fluids where the stabilizer can be diaryl amine or alkylated phenol, U.S. Pat. No. 4,089,792 discloses lubricants having an antioxidant mixture of a primary amine and an antioxidant selected from aromatic or alkyl sulfides and polysulfides, sulforized olefins, sulforized carboxylic acid esters and sulfurized ester-olefins.

SUMMARY OF THE INVENTION

The present is directed in part to a lubricating oil composition which provides improved oxidation stability. According the compositions of the present invention have various uses such as lubricants for automotive and truck crankcase lubricants; as well as transmission lubricants, gear lubricants, hydraulic fluids, compressor oils, diesel and marine lubricants. A composition comprising a lubricating oil and an oil soluble synergistic mixture of antioxidants, said mixture comprising;

a) from 0.1 to 10 weight percent of a first antioxidant according to formula I:

Formula I

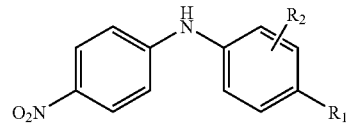

wherein $R_1$ is selected from the group consisting of alkyl from 3 to 24 carbon atoms, —NHR, —NRR where R is independently selected alkyl from 1 to 18 carbon atoms; $R_2$ is hydrogen or alkyl from 1 to 20 carbon atoms; and b) from 0. 1 to 5 weight percent of a second antioxidant selected from the formula Formula II

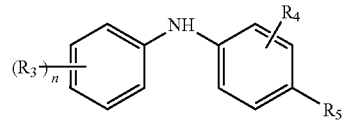

wherein $R_3$ and $R_4$ are each independently hydrogen or alkyl from 1 to 20 carbon atoms; n is an integer from 1 to 3; $R_5$ is selected from the group consisting of branched and straight chain hydrocarbyl radicals having from 3 to 24 carbon atoms selected from alkyl, alkoxy, aralkyl or alkaryl, or —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a five- or six-membered heterocyclic ring.

Dramatic improvement of the combination of component a) and component b) is demonstrated at ratios of component a) to component b) from about is from about 1.25:1 to about 5:1 and preferably about 1.5:1 or greater. Due to the dramatic improvement in oxidative stability of the composition afforded by the mixture of components a) & b), the mixture of these components present in the total composition is less than 5 weight percent. More preferably the mixture of a) & b) is from 0.5 to 2.0 weight percent based on the total weight of the composition.

The substituents on the nitro-substituted diphenylamine of formula I and the substituted diarylamine of formula II, are imparted partly to improve performance and partly to improve the oil solubility of the compound so that it is soluble in the lubricating oil at the requisite concentrations. For oil solubility alkyl and amino groups are added and when $R_1$ is a straight or branched chain alkyl group preferably from 3 to 24 carbon atoms, more preferably from 4 to 18 carbons. In another aspect, $R_1$ is selected from —NHR or —NRR wherein R is an independently selected alkyl group from 3 to 12 carbon atoms. In this aspect, dialkylamino groups have indicated good results. Depending upon the substituent for $R_1$, then $R_2$ may be hydrogen, and typically $R_2$ is not required for oil-solubility and is hydrogen.

In the compounds of formula II, $R_3$ is independently selected at each occurrence from hydrogen, thus the benzene group defined with $R_3$ can be unsubstituted, monoalkylated, dialkylated or trialkylated, where the alkyl groups may be the same or different. In the un-substituted aspect $R_3$ are all hydrogen. Preferably if $R_3$ is alkyl is ortho or para to the bridging ring nitrogen atom, more preferably in the para position. In one aspect, $R_5$ is selected from alkyl from 3 to 24 carbon atoms, preferably from 4 to 18 carbon atoms, or —$NHR_6$, —$NR_6R_7$ where $R_6$ and $R_7$ are independently selected alkyl from 1 to 18 carbon atoms, preferably form 6 to 12carbon, atoms. Yet another aspect, $R_5$ is selected from —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a five- or six-membered heterocyclic ring.

The composition defined above can contain other additives. Thus another aspect of the present invention further comprises component c) an oil soluble molybdenum compound. A particularly preferred oil soluble molybdenum compound is an unsulfurized or sulfurized oxymolybdenum containing composition prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex. More preferably the basic nitrogen compound is a succinimide. The composition defined above may contain other antioxidant components and preferably those that act by a different mechanism. Particularly preferred are peroxide decomposer antioxidants. Suitable supplemental antioxidants generally include hindered phenols, hindered bisphenols, sulfurized phenols, sulfurized olefins, alkyl sulfides and polysulfides, dialkyl dithiocarbamates and phenothiazines. Particularly preferred are hindered phenolic antioxidants.

The composition above can further comprise an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides. Preferred said phosphorus esters are selected from the group consisting of phosphates, phosphonates, phosphinates, phosphine oxides, phosphites, phosphonites, phosphinites, and phosphines. Particularly preferred oil-soluble, phosphorus-containing, anti-wear compound is a metal dithiophosphate, such as zinc dialkyldithiophosphate.

The composition above can contain an oil soluble decomposer of peroxides.

Another aspect is directed to an antioxidant system useful in lubricating oil compositions comprising a major amount of a lubricating oil composition and an oil soluble antioxidant system selected from a mixture of a secondary diarylamine and a nitro-substituted secondary diarylamine. This system may further comprise an oil soluble molybdenum compound.

Another aspect is directed to a method to delay the onset of oxidation in a lubricating oil composition containing a lubricating oil and a secondary diarylamine antioxidant, said method comprising adding to said lubricating oil composition an effective amount of a nitro containing compound of formula I:

Formula I

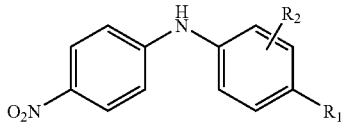

wherein:

$R_1$ is selected from the group consisting of alkyl from 3 to 24carbon atoms, —NHR, —NRR where R is independently selected alkyl from 1 to 18 carbon atoms; $R_2$ is hydrogen or alkyl from 1 to 20 carbon atoms; and thereafter, subjecting the lubricating oil composition to oxidative conditions. These oxidative conditions may be undertaken by subjecting the composition as lubricating oil in an internal combustion engine such as in lubricants for automotive and truck crankcase lubricants; as well as transmission lubricants, gear lubricants, hydraulic fluids, compressor oils, diesel and marine lubricants.

DETAILED DESCRIPTION OF THE INVENTION

Inhibition of free radical-mediated oxidation is one of the most important reactions in organic substrates and is commonly used in robbers, polymers and lubrication oils; namely, since these chemical products may undergo oxidative damage by the autoxidation process. Hydrocarbon oxidation is a three step process which comprises: initiation, propagation and termination. Oxidative degradation and the reaction mechanisms are dependent upon the specific hydrocarbons, temperatures, operating conditions, catalysts such as metals, etc., which more detail can be found in Chapter 4 of Mortier R. M, et al., 1992, "Chemistry and Technology of Lubricants Initiation", VCH Publishers, Inc.; incorporated herein by reference in its entirety. Initiation involves the reaction of oxygen or nitrogen oxides ($NO_x$) on a hydrocarbon molecule. Typically, initiation starts by the abstraction of hydrocarbon proton. This may result in the formation of hydrogen peroxide (HOOH) and radicals such as alkyl radicals (R.) and peroxy radicals (ROO.). During the propagation stage, hydroperoxides may decompose, either on their own or in the presence of catalysts such as metal ions, to alkoxy radicals (RO.) and peroxy radicals. These radicals can react with the hydrocarbons to form a variety of additional radicals and reactive oxygen containing compounds such as alcohols, aldehydes, ketones and carboxylic acids; which again can further polymerize or continue chain propagation. Termination results from the self termination of radicals or by reacting inhibitors.

The uncatalyzed oxidation of hydrocarbons at temperatures of up to about 120° C. primarily leads to alkyl-hydroperoxides, dialkylperoxides, alcohols, ketones; as well as the products which result from cleavage of dihydroperoxides such as diketones, keto-aldehydes hydroxyketones and so forth. At higher temperatures (above 120° C.) the reaction rates are increased and cleavage of the hydroperoxides plays a more important rote. Additionally, at the higher temperatures, the viscosity of the bulk medium increases as a result of the polycondesation of the difunctional oxgenated products formed in the primary oxidation phase. Further polycondesation and polymerization reaction of these high molecular weight intermediates results in products which are no longer soluble in the hydrocarbon and form varnish like deposits and sludge, Since autoxidation is a free-radical chain reaction, it therefore, can be inhibited at the initiation and/or propagation steps. Typical oxidation inhibition by diarylamines, such as dialkyldiphenylamine and N-phenyl-α-napthylamine, also involves radical scavenging. The transfer of hydrogen from the NH group of the amine to the peroxide radicals results in the formation of a diarylamino radical which is resonance stabilized, thus prevents new chains from forming. A secondary peroxy radical or hydroperoxide can react with the diarylamino radical to form the nitroxy radical, which is also a very potent inhibitor. Increased demands have been placed on many functional fluids which have in-turn placed emphasis on new inhibitors.

The present invention is directed in part to a mixture of compounds which imparts a synergistic antioxidant effect in a hydrocarbon. The first component a) is nitro-substituted diarylamine compound which alone is not particularly useful as a stabilizer for it has no appreciable effect on oxidation stability; however in addition with component b) a secondary aryl amine, the combination has improved oxidation stability. Synergism has been suggested for combinations of different types of antioxidants also called heterosynergism due to the different mechanism of stabilizer, for example a combination of radical scavengers and peroxide decomposers. Additionally, it has been suggested even within the same class, compounds which act by a different reaction mechanism/rate may lead to synergist results, for example combinations of hindered phenolics and alkylated diphenylamines has been studied. Heretofore, synergism has not demonstrated for a mixture of a) nitro-substituted diarylamine compound and b) a secondary aryl amine.

Nitroaromatics are known to react with alkyl and peroxy radicals in polypropylene and polyethylene to form trisubstituted hydroxylamines, see Shilov, Y. B.; Denisov, E. T.; *Kinetics and Catalysis* (2001), 42(2), 238-242. b) Norris, W. P.; *J. Amer. Chem. Soc.* (1959), 81(16), 4239-4243. However, nitrodiphenylamines offer little or no oxidation control when used in lubricating oils.

Surprisingly as illustrated Examples, there is synergy when an oil soluble nitro substituted diphenylamine is combined with a substituted secondary diphenylamine. Therefore, this invention is directed in part to the discovery that nitrodiphenylamines containing alkyl or alkylamino functionality when used in conjunction with alkyl or alkylamino substituted diphenylamines offer excellent prolonged oxidation control While not being bound by any theory, this could be based in part that a nitrodiphenylamine may react with either alkyl of peroxy radicals in lubricating oil to form a diphenylamine trisubstituted hydroxylamine if the radical reacted with the nitro group faster than it reacted with, the N—H of the diphenylamine. At high temperatures one could then conjecture that the N—O bond could undergo cleavage to form an aminodiphenylamine. Thus, the electron withdrawing group could be converted into an electron donating group at high temperatures. However, this lack of effectiveness may be due to the rate at which the nitrodiphenylamine is converted into the aminodiphenylamine and the high temperatures that may be required. During the initial phase before the chemical transformation occurs the rapid oxidation of the oil has already happened. Our thoughts were that this problem could be overcome by adding additional functionality to the nitrodiphenylamine to alter its initial reactivity towards radicals and affecting the rate at which N—O bond cleavage occurs. Using this type of substituted nitrodiphenylamine in combination with a diphenylamine free from nitro groups and substituted with appropriate electron donating groups gave initial oxidation protection before the desired chemical transformation would occur. This combination would then lead to prolonged oxidation control. Nitro-Substituted Diarylamine Compound—Component a)

Component a) is an oil soluble nitro-substituted diarylamine compound which alone shows no appreciable application as an antioxidant, antiozoant, or heat stabilizer. The term oil-soluble as used herein does not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended-effect in the environment in which the oil is employed. Moreover, the additional incorporation of other additives may also permit incorporation of higher levels of a particular additive, if desired.

Disclosed are particularly suited resonance stabilized inhibitor compounds according to formula I;

Formula I

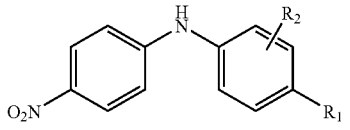

Wherein $R_1$ is selected from the group consisting of alkyl from 3 to 24 carbon atoms, —NHR, —NRR where R is independently selected alkyl from 1 to 18 carbon atoms; $R_2$ is hydrogen or alkyl from 1 to 20 carbon atoms. Improved resonance stabilization may be accomplished by substituents on the rings, thus particularly preferred groups are electron donating groups, more so when positioned ortho and para positions to the bridging nitrogen atom, thereby stabilizing this amino radical. As used herein the term electron-donor or electron releasing substituent refers to a substituent which when bonded to a benzene nucleus tends to supply electrons and to increase the electron density of the benzene nucleus. Substituent groups also improve the oil solubility of the resulting compound, thus alkyl groups and alkylamino and dialkylamino groups can impart improve oil solubility and improve performance. As used herein alkyl groups include straight and branched chain and mixtures thereof. In one aspect, $R_1$ is alkyl from 4 to 18. Commonly, alkyl groups may be derived from $C_3$ or $C_4$ olefins referred to here include propylene, 1-butene, 2-butene and isobutylene, among which propylene and isobutylene are preferable for imparting good solubility of the product in base oil. Specifically, a branched octyl group derived from an isobutylene dimer, a branched nonyl group derived from a propylene trimer, a branched dodecyl group derived from an isobutylene trimer, a branched dodecyl group derived from a propylene tetramer or a branched pentadecyl group derived from a propylene pentamer is particularly preferable. An attractive synthesis for nitro-substituted diarylamine compounds is the reaction of an optionally substituted aniline with an optionally substituted nitrobenzene in the presence of a base, as disclosed for example In U.S. Pat. Nos. 5,608,111; 5,739,403 and 5,117,063. Monoalkyl amines and dialkyl amines are adept electron donating groups, for improved oil solubility preferably the alkyl group is from 3 to 12 carbon atoms.

Nitro-diphenylamines are commonly prepared precursors used in the making of 4-Aminodiphenylamine; which itself is an important intermediate in the manufacture of alkylated derivatives having utility as antiozonates and antioxidants, as stabilizers for monomers and polymers and in various specialty chemical products typically in the rubber industry and polymer industry. Depending on starting materials, current methods for preparing 4-aminodiphenylamine include: (1) aniline method, wherein p-nitro-chlorobenzene and aniline as raw materials react in the presence of a catalyst to produce 4-nitrodiphenylamine, then 4-nitrodiphenylamine is reduced by sodium sulfide to form 4-aminodiphenylamine; (2) formanilide method, wherein formic acid and aniline are used as stating materials to prepare formanilide, which in turn reacts with p-nitro-chlorobenzene in the, presence of an acid-binding agent such as potassium carbonate, to produce 4-nitrodiphenylamine, and then 4-nitrodiphenylamine is reduced by sodium sulfide to form 4-aminodiphenylamine; (3) diphenylamine method, wherein diphenylamine as raw material is nitrated using a nitrite in an organic solvent to produce N-nitrodiphenylamine, which rearranges to 4-nitrodiphenylamine hydrochloride under the action of anhydrous hydrogen chloride, then 4-nitrodiphenylamine hydrochloride is neutralized with a base to give 4-nitrodiphenylamine, and said 4-nitrodiphenylamine is finally reduced to 4-aminodiphenylamine by sodium sulfide. Although these methods use different starting materials, traditional sodium sulfide is used as reducing agent to prepare 4-aminodiphenylamine. These reactions suffer from severe reaction conditions, complex operation, higher energy consumption, lower yield, higher cost and environment pollution caused by concomitant waste water, waste gas and waste residue.

The commercialized process for preparing 4-aminodiphenylamine is largely divided into two processes. The first may be-referred to as the Ouchi process. According to the Ouchi process, N-nitrodiphenylamine Is formed via reaction between diphenylamine and sodium nitrate ($NaNO_2$), followed by Fischer-Hepp rearrangement to neutralize the reactant. Then it is finally prepared under the general hydrogenation. However, this process also has some disadvantages in that a large amount of harmful waste solution is generated due to nitrosation. The second process may be referred to as the Monsanto process (U.S. Pat. Nos. 5,117,063; 5,453,541; 5,608,111; 5,623,088). According to the Monsanto process, p-chloronitrobenzene is formed by nitrating chlorobenzene, following by a reaction with formanilide to prepare 4-nitrodiphenyl amine. Then 4-aminodiphenylamine is finally prepared under the general hydrogenation.

The compounds of formula I are not particularly useful when employed by themselves in a lubricating composition. The examples herein and the art known in lubricating oil compositions illustrate that there is no benefit in the oxidation test from employing the nitro-substituted diarylamine compound. The compounds of formula I with an oil of lubricating viscosity by themselves do not improve oxidative stability. However the addition of a diarylamine with the nitro-substituted diarylamines of formula I demonstrate a dramatic advantaged delayed antioxidant effect and added robustness. The concentration of the compound of formula I in the lubricating composition can vary depending upon the requirements, applications and degree of synergy desired. In a preferred embodiment of the invention, a practical nitro-substituted diarylamine use range in the lubricating composition is from about 1,000 parts per million to 20,000 parts per million (i.e. 0.1 to 2.0 wt %) based on the total weight of the lubricating oil composition, preferably the concentration is from 1,000 to 10,000 parts per million (ppm) and more preferably from about 2,000 to 8,000 ppm by weight.

Diarylamine—Component b):

Secondary diarylamines are well known antioxidants. These are particularly suited for extending the life of engine oils which function at high temperatures in the presence of radical forming catalysts in an oxygen rich atmosphere offers severe oxidation control challenges. Diphenylamines scavenge peroxy radicals formed from the rapid reaction of carbon radicals from the lubricating oil with oxygen. The oxidized diphenylamines are capable of regenerating themselves at high temperatures via N—O bond cleavage. It is known in the art that electron donating groups enhance the effectiveness of diphenylamines and electron withdrawing groups are detrimental to their performance.

Preferably, the secondary diarylamine antioxidant is one of the formula

Formula II

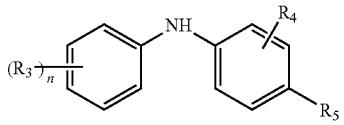

wherein $R_3$ and $R_4$ are each independently hydrogen or alkyl from 1 to 20 carbon atoms; n is an integer from 1 to 3; $R_5$ is selected from the group consisting of branched and straight chain hydrocarbyl radicals having from 3 to 24 carbon atoms selected from alkyl, alkoxy, aralkyl or alkaryl, or —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a five- or six-membered heterocyclic ring.

As evident from formula II, the diphenylamine has at least one or more substituents on at least one phenyl ring. The ring substituents may aide in providing oil solubility and increase the efficiency of the inhibitor, particularly if the substituent is an electron donor (or electron releasing) functional group. The electron donor substituent when bonded to a benzene nucleus tend to supply electrons to and to increase the electron density of the benzene nucleus, this in turn can help stabilize the bridging amino moiety leading to more favorable N—H bond dissociation characteristics. Suitable substituents are straight and branched chain alkyl groups, referred to simply as alkyl alkoxy and amino groups as well as groups derived by these. Particularly suited are para substituted groups as depicted by $R_5$ in formula II, thus $R_5$ is selected from the group consisting of branched and straight chain hydrocarbyl radicals having from 3 to 24 carbon atoms selected from alkyl, alkoxy, aralkyl, or alkaryl, or —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a five- or six-membered heterocyclic ring.

In one aspect, $R_5$ is alkyl or groups derived from alkyl, more particularly R5 is selected from the group consisting of branched and straight chain hydrocarbyl radicals having from 3 to 24 carbon atoms selected from alkyl, alkoxy, aralkyl or alkaryl. Particular alkyl groups are from 4 to 12 carbons. The aralkyl and alkaryl moieties are preferably substituted phenyl moieties, particularly substituted with alkyl, such as one having 4 to 18 carbon atoms, In an aspect, $R_5$ is —$NHR_6$, —$NR_6R_7$ where $R_6$ and $R_7$ are independently selected alkyl from 1 to 18 carbon atoms* or when $R_4$ is positioned adjacent to $R_5$ then $R_6$ together with $R_4$ can form a five- or six-membered heterocyclic ring. The amino substitution has demonstrated efficiency both for mono alkyl and dialkyl as well as when the amino is a fused heterocyclic group. These optionally substituted (2,3-dihydro-1H-indole-5yl)-phenyl-amine and optionally substituted phenyl-(1,2,3,4-tetrahydro-quinolin-6-yl)-amines are depicted in Compounds of formula III and formula IV respectively.

$R_3$ and $R_4$ are each independently hydrogen or alkyl from 1 to 20 carbon atoms, can have either a straight chain or a branched chain; for example, methyl, ethyl, propyl, butyl pentyl, hexyl, heptyl, octyl, nonyl, decyl, undecyl, dodecyl, tridecyl, tetradecyl, pentadecyl, hexadecyl, heptadecyl, octadecyl, nonadecyl, and the like, and isomers and mixtures thereof. Particular substituents are para and ortho to the bridging nitrogen atom of the diphenylamine. Thus, for example when at least one $R_3$ is other than hydrogen, this alkyl group will typically be in para position. The subsequent second independently selected alkyl group for $R_3$ will preferably be in the ortho position as will the third independently selected alkyl group for $R_3$. The hydrogen and/or alkyl group for $R_3$ is independently selected for each value of n.

For exhibiting good solubility of their oxidized product in base oil, these $C_{24}$ and $C_{20}$ or less alkyl groups are preferably $C_{8-16}$ branched alkyl groups, more preferably those $C_{8-16}$ branched alkyl groups derived from oligomers of $C_3$ or $C_4$olefins. The $C_3$ or $C_4$ olefins referred to here include propylene, 1-butene, 2-butene and isobutylene, among which propylene and isobutylene are preferable for good solubility of their oxidized product in base oil. Specifically, a branched octyl group derived from an isobutylene dimer, a branched nonyl group derived from a propylene trimer, a branched dodecyl group derived from an isobutylene trimer, a branched dodecyl group derived from a propylene tetramer or a branched pentadecyl group derived from a propylene pentamer is particularly preferable. The substituted secondary diaryl amines and particularly p,p'-dialkyl diphenyl amines and N-p-alkylphenyl-α-naphthyl amines, may be a commercially available product, but can be easily produced by reacting the diaryl amine with a $C_{1-6}$ alkyl halide; a $C_{2-6}$ olefin, or a $C_{2-6}$ olefin oligomer with secondary diaryl amine by use of a Friedel-Grafts catalyst. Examples of the Friedel-Crafts catalyst are metal halides such as aluminum chloride, zinc chloride and iron chloride, and acidic catalysts such as sulfuric acid, phosphoric acid, phosphorus pentoxide, boron fluoride, acidic clay and active clay. Other alkylation methods are known in the art.

These secondary diarylamines may be substituted at one or both rings with alkyl groups, preferably straight and branched alkyl groups from 4 to 12 carbon atoms, more preferably 8 to 9 carbon atoms. Commonly mixtures of alkylated diphenylamines are prepared such as that prepared by reacting diphenylamine with 2,4,4-trimethylpentyl; or employing other alkyl groups, preferably branched chain to prepare for example nonylated diphenylamine (bis(4-nonylphenyl) amine) or octylated-butylated diphenyl amine.

Examples of some of the secondary diarylamines that are useful in the practice of the present invention include: diphenylamine, monoalkylated diphenylamine, dialkylated diphenylamine, trialkylated diphenylamine, or mixtures thereof, mono- and/or di-butyldiphenylamine, mono- and/or di-octyldiphenylamine, mono- and/or di-nonyldiphenylamine, diheptyldiphenylamine, mixtures of mono- and dialkylated t-butyl-t-octyldiphenylamine.

Examples of commercial diarylamines include, for example, IRGANOX L06, IRGANOX L57 and IRGANOX L67 from Ciba Specialty Chemicals; NAUGALUBE AMS, NAUGALUBE 438, NAUGALUBE 438R, NAUGALUBE 438L, NAUGALUBE 500, NAUGALUBE 640, NAUGALUBE 680, from Crompton Corporation; GOODRITE 3123, GOODRITE 3190X36, GOODRITE 3127, GOODRITE 3128, GOODRITE 3185X1, GOODRITE 3190X29, GOODRITE 3190X40, GOODRITE 3191 and GOODRITE 3192 from BF Goodrich Specialty Chemicals; VANLUBE DND, VANLUBE NA, VANLUBE PNA, VANLUBE SL, VANLUBE SLHP, VANLUBE SS, VANLUBE 81, VANLUBE 848, and VANLUBE 849 from R. T. Vanderbilt Company Inc.

The compounds of formula III are represented below.

Formula III

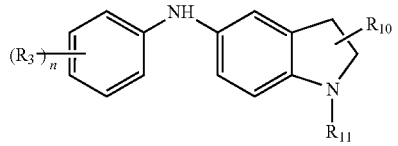

wherein $R_3$ and n are defined herein above, $R_{10}$ is selected from the group of hydrogen or linear or branched alkyl from 1 to 18 carbon atoms, and $R_{11}$ is selected from the group of hydrogen or linear or branched alkyl from 1 to 18 carbon atoms. In one aspect, $R_3$ is hydrogen at each occurrence. When $R_3$ is alkyl preferably $R_3$ is ortho or para to the bridging nitrogen atom, more preferably in the para position. In one aspect $R_{10}$ is hydrogen or alkyl from 1 to 6 carbon atoms, preferably hydrogen. In an aspect, $R_{11}$ is hydrogen or alkyl from 1 to 6 carbon atoms, preferably hydrogen.

The compounds of formula IV are represented below.

Formula IV

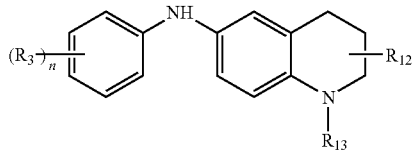

wherein $R_3$ and n are defined herein above, $R_{12}$ is selected from the group of hydrogen or linear or branched alkyl from 1 to 18 carbon atoms, and $R_{13}$ is selected from the group of hydrogen or linear or branched alkyl from 1 to 18 carbon atoms. In one aspect, $R_3$ is hydrogen at each occurrence. When $R_3$ is alkyl preferably $R_3$ is ortho or para to-the bridging nitrogen atom, more preferably in the para position. In one aspect $R_{12}$ is hydrogen or alkyl from 1 to 6 carbon atoms, preferably hydrogen. In an aspect, $R_{13}$ Is hydrogen or alkyl from 1 to 6 carbon atoms, preferably hydrogen.

The concentration of the secondary diarylamine in the lubricating composition can vary depending upon the requirements, applications and degree of synergy desired. In a preferred embodiment of the invention, a practical secondary diarylamine use range in the lubricating composition is from about 1,000 parts per million to 20,000 parts per million (i.e. 0.1 to 2.0 wt %). based on the total weight of the lubricating oil composition, preferably the concentration is from 1,000 to 10,000 parts per million (ppm) and more preferably from about 2,000 to 8,000 ppm by weight.

Typically, with regard to total antioxidant in the lubricating composition, quantities of less than 1,000 ppm have little or minimal effectiveness whereas quantities larger than 50,000 ppm are generally not economical. Preferably the total amount of component a) and component b) in the lubricating oil composition is from about 0.1 to 2 wt % and more preferably from about 0.5 to about 2 wt % based upon the total weight of the lubricating oil composition.

Oil of Lubricating Viscosity

The lubricant compositions of this invention include a major amount of base oil of lubricating viscosity. Base Oil as used herein is defined as a base stock or blend of base stocks which is a lubricant component that is produced by a single manufacturer to the same specifications (independent of feed source or manufacturer's location): that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C.) and about 5 centistokes (cSt) to about 20 cSt, preferably about 7 cSt to about 16 cSt, more preferably about 9 cSt to about 15 cSt. Hydrocarbon, synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100 degrees C.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils Include those in all API categories I, II, III, IV and V as defined in API Publication 1509, 14th Edition, Addendum I, December 1998. Saturates levels and viscosity indices for Group I, II and III base oils are listed in Table 1. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

TABLE 1

Saturates, Sulfur and Viscosity Index of Group I, II and III Base Stocks

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum, oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which, are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of this invention. A major amount of base oil as defined herein comprises 40 wt. % or more. Preferred amounts of base oil comprise about 40 wt. % to about 97 wt. % of at least one of Group II, III and IV base oil or preferably greater than about 50 wt. % to about 97 wt. % of at least one of Group II, III and IV base oil or more preferably about 60 wt. % to about 97 wt. % of at least one of Group II, III and IV base oil. (When wt. % is used herein, it is referring to wt % of the lubricating oil unless otherwise specified.) A more preferred embodiment of this invention may comprise an amount of base oil that comprises about 85 wt. % to about 95 wt. % of the lubricating oil.

Oil Soluble Molybdenum Compound—Component c)

Oil soluble molybdenum compounds and molybdenum/sulfur complexes are known in the art and are described, for example, in U.S. Pat. No. 4,263,152 to King et al., and U.S. Pat. No. 6,962,896 to Ruhe, the disclosures of which is hereby incorporated by reference and which are particularly preferred. Other representative of the molybdenum compounds which can be used in this invention include: glycol molybdate complexes as described by Price et al., in U.S. Pat. No. 3,285,942; overbased alkali metal and alkaline earth metal sulfonates, phenates and salicylate compositions containing molybdenum such as those disclosed and claimed by Hunt et al in U.S. Pat. No. 4,832,857; molybdenum complexes prepared by reacting a fatty oil, a diethanoiamine and a molybdenum source as described by Rowan et al in U.S. Pat. No. 4,889,647; a sulfur and phosphorus-free organomolybdenum complex of organic amide, such as molybdenum containing compounds prepared from fatty acids and 2-(2-aminoethyl) aminoethanol as described by Karol in U.S. Pat. No. 5,137,647 and molybdenum containing compounds prepared from 1-(2-hydroxyethyl)-2-imidazoline substituted by a fatty residue derived from fatty oil or a fatty acid; overbased molybdenum complexes prepared from amines, diamines, alkoxylated amines, glycols and polyols as described by Gallo et al in U.S. Pat. No. 5,143,633; 2,4-heteroatom substituted-molybdena-3,3-dioxacycloalkanes as described by Karol in U.S. Pat. No. 5,412,130; and mixtures thereof. Representative molybdenum compounds of the above are commercially available and include but, are not limited to; Sakura-Lube® 700 supplied by the Asahi Denka Kogyo K. K. of Tokyo, Japan, a molybdenum amine complex; molybdenum HEX-CEM®. supplied by the OM Group, Inc., of Cleveland, Ohio, a molybdenum 2-ethylhexanoate; molybdenum octoate supplied by The Shepherd Chemical Company of Cincinnati, Ohio, a molybdenum 2-ethylhexanoate; Molyvan® 855 supplied by the R. T, Vanderbilt Company, Inc., of Norwalk, Conn., a sulfur and phosphorus-free organomolybdenum complex of organic amide; Molyvan® 856-B also from R. T. Vanderbilt, an organomolybdenum complex.

Particularly preferred oil soluble molybdenum complexes are unsulfurized or sulfurized oxymolybdenum containing compositions which can be prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex. This oxymolybdenum complex can be reacted with a sulfur containing compound, to thereby form a sulfurized oxymolybdenum containing composition, useful within the context of this invention. Preferably the dispersant is a polyisobutenyl succinimide. The oxymolybdenum or sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. The precise molecular formula of these oxymolybdenum compositions are not known with certainty. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions. In one aspect, the oxymolybdenum complex is prepared at a reaction temperature at or below 120 degrees centigrade and if optionally sulfurized, it is also reacted at or below 120 degrees centigrade. Such a process yields a lighter color product when compared to higher temperature reaction conditions at equivalent pressure, The molybdenum compounds used to prepare the oxymolybdenum and oxymplybdenum/sulfur complexes employed in this invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g., hydrogen sodium molybdate, $MoOcl_4$, $MoO_2Br_2$, $Mo_2O_3Cl_6$, molybdenum trioxide, bis (acetylacetonato)-dioxomolybdenum (VI) or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen compound used to prepare the oxymolybdenum complexes have at least one basic nitrogen and are preferably oil-soluble. Typical examples of such compositions are succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. Any of the nitrogen-containing compositions may be after-treated with, e.g., boron, using procedures well known in the art so long as the compositions continue to contain basic nitrogen. These after-treatments are particularly applicable to succinimides and Mannich base compositions.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. No's. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine.

Carboxylic acid amide compositions are also suitable starting materials for preparing the oxymolybdenum complexes employed in this invention. Typical of such compounds are those disclosed in U.S. Pat. No. 3,405,064, the disclosure of which is hereby incorporated by reference. These compositions are ordinarily prepared by reacting carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula R'COOH, where R' is $C_{12-20}$ alkyl or a mixture of this acid with a polyisobutenyl carboxylic acid in which the polyisobutenyl group contains from 72 to 128 carbon atoms and (2) an ethylene amine, especially triethylene tetramine or tetraethylene pentamine or mixtures thereof.

Another class of compounds which are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen are the Mannich base compositions. These compositions are prepared from a phenol or $C_{9-200}$ alkylphenol, an aldehyde, such as formaldehyde or formaldehyde precursor such as paraformaldehyde, and an amine compound. The amine may he a mono or polyamine and typical compositions are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 4,157,309 and 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the oxymolybdenum complexes employed in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compositions useful in preparing the molybdenum complexes employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases. More preferred are succinimides having an average molecular weight of 1000 or 1300 or 2300 and mixtures thereof. Such succinimides can be post treated with boron or ethylene carbonate as known in the art.

The oxymolybdenum complexes of this Invention can also be sulfurized. Representative sulfur sources for preparing the oxymolybdenum/sulfur complexes used in this invention are sulfur, hydrogen sulfide, sulfur monochloride, sulfur dichloride, phosphorus pentasulfide, $R''_2S_x$ where R" is hydrocarbyl, preferably $C_{1-40}$ alkyl, and x is at least 2, inorganic sulfides and polysulfides such as $(NH_4)_2S_y$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof. These sulfur containing antioxidants are useful when employed as additional antioxidants since they are effective peroxide decomposers and are further described herein below, The sulfurized fatty acid esters are prepared by reacting sulfur, sulfur monochloride, and/or sulfur dichloride with an unsaturated fatty ester under elevated temperatures. Typical esters include $C_1$-$C_{20}$ alkyl esters of $C_{8-C24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, caster oil, peanut oil, rape oil, fish oil, sperm oil, and so forth. Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$-$C_{25}$ olefins with fatty acid esters of $C_{10}$-$C_{25}$ fatty acids and $C_{10}$-$C_{25}$ alkyl or alkenyl alcohols, wherein the fatty acid and/or the alcohol is unsaturated may also be used.

Sulfurized olefins are prepared by the reaction of the $C_3$-$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compositions such as sulfurized dodecylphenol and the calcium salts thereof. The alkyl group ordinarily contains from 9-300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R''_2S_z$ where R" is hydrocarbyl, preferably $C_1$-$C_{10}$ alkyl, and z is at least 3, mercaptans wherein R" is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this invention is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water. While ordinarily the polar promoter is separately added to the reaction mixture, it may also be present, particularly in the ease of water, as a component of non-anhydrous starting materials or as waters of hydration in the acidic molybdenum compound, such as $(NH_4)_6Mo_7O_{24}.H_2O$. Water may also be added as ammonium hydroxide.

A method for preparing the oxymolybdenum complexes used in this invention is to prepare a solution of the acidic molybdenum precursor and a polar promoter with a basic nitrogen-containing compound with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a variety of temperatures, typically at or below the melting point of the mixture to reflux temperature. It is ordinarily carried out at atmospheric pressure although higher or lower pressures may be used if desired. This reaction mixture may optionally be treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source. In a preferred and improved method for preparing the oxymolybdenum complexes, the reactor is agitated and heated at a temperature less than or equal to about 120 degrees Celsius, preferably from about 70 degrees Celsius to about 90 degrees Celsius. Molybdic oxide or other suitable molybdenum source is then charged to the reactor and the temperature is maintained at a temperature less than or equal to about 120 degrees Celsius, preferably at about 70 degrees Celsius to about 90 degrees Celsius, until the molybdenum is sufficiently reacted. Excess water is removed from the reaction mixture. Removal methods include but are not limited to vacuum distillation or nitrogen stripping while maintaining the temperature of the reactor at a temperature less than or equal to about 120 degrees Celsius, preferably between about 70 degrees Celsius to about 90 degrees Celsius. The temperature during the stripping process is held at a temperature less than or equal to about 120 degrees Celsius to maintain the low color intensity of the molybdenum-containing composition. It is ordinarily carried out at atmospheric pressure although higher or lower pressures may be used. The stripping step is typically carried out for a period of about 0.5 to about 5 hours.

If desired, this product can be sulfurized by treating this reaction mixture with a sulfur source as defined above at a suitable pressure and temperature, not to exceed about 120 degrees Celsius for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.3 to 1.0, and most preferably from 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. For extremely low sulfur incorporation the sulfur to molybdenum weight ratio can be from (0.01 to 0.08) to 1.

The sulfurized and unsulfurized oxymolybdenum complexes of this invention are typically employed in a lubricating oil in an amount of 0.01 to 10% more preferably from 0.04 to 1 wt %.

Additional components may be added to the synergist combination of component a) and component b) and optionally component c) to further the resistance to oxidation of the organic substrate and which may add to the synergism. Particularly preferred is a component which operates as a peroxy radical scavenger. These hydroperoxide decomposers convert hydroperoxides into non-radical products thus preventing chain propogation reactions. Commonly organosulfur and organophophorous compounds have severed this purpose, and many suitable compounds have identified herein above with regard the oxymolybdenum component and need not be repeated again. Particularly preferred organophosphorous compounds are the oil-soluble, phosphorus-containing, antiwear compounds selected from the group consisting of metal dithiophosphates, phosphorus esters (including phosphates, phosphonates, phosphinates, phosphine oxides, phosphites, phosphonites, phosphinites, phosphines and the like), amine phosphates and amine phosphinates, sulfur-containing phosphorus esters including phosphoro monothionate and phosphoro dithionates, phosphoramides, phosphonamides and the like. More preferably, the phosphorus-containing compound is a metal dithiophosphate and, even more preferably, a zinc dithiophosphate* Suitable phosphorous compounds are disclosed in U.S. Pat. No. 6,696,393, incorporated herein by reference.

The following additive components are examples of components that can be favorably employed in combination with the lubricating additive of the present invention. These examples of additives are provided to illustrate the present invention, but they are not intended to limit it.

(A) Ashless dispersants: alkenyl succinimides, alkenyl succinimides modified with other organic compounds such as ethylene carbonate, polysuccinimides, and alkenyl succinimides modified with, boric acid, alkenyl succinic ester.

(B) Oxidation inhibitors:

1) Phenol type phenolic oxidation inhibitors: 4,4'-methylenebis(2,6-di-tert-butylphenol),4,4'-bis(2,6-di-tert-butylphenol), 4,4'-bis(2-methyl-6-tert-butylphenol), butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4'-methyl-6-nonylphenol), 2,2'-isobutylidenebis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4(N, N'dimethylaminomethylphenol),4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl). 2) Diphenylamine type oxidation inhibitor: alkylated diphenylamine, phenyl-α-naphthylamine, and alkylated α-naphthylamine, 3) Other types; metal dithiocarbamate (e.g., zinc dithiocarbamate), and methylenebis (dibutyldithiocarbamate). Particularly preferred hindered phenolics are detailed below.

In another embodiment, the antioxidant is a peroxide decomposer antioxidant (D). Particularly suited is (D) is at least one phenol antioxidant. The phenol antioxidants include metal and metal free hindered phenols. Alkylene coupled derivatives of hindered phenols and phenol sulfides or sulfur coupled phenols may also be used. Hindered phenols are defined as those containing a sterically hindered hydroxyl group, and these include those derivatives of dihydroxy aryl compounds wherein the hydroxyl groups are in the o- or p-position to each other. The metal-free hindered phenols may be represented by the following formulae:

IIIa

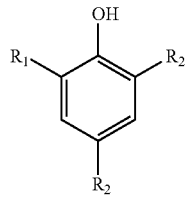

IVa

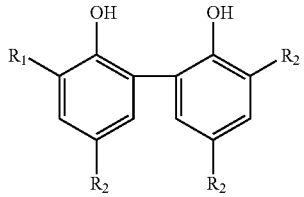

Va

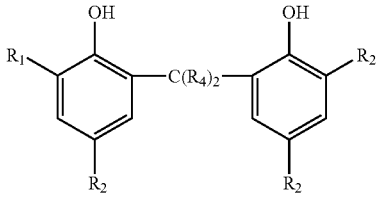

wherein each $R_1$ is independently a hydrocarbyl group containing from 3 to about 9 carbon atoms, each $R_2$ is hydrogen or a hydrocarbyl group, $R_3$ is hydrogen or a hydrocarbyl group containing from 1 to about 9 carbon atoms, and each $R_4$ is independently hydrogen or a methyl group. In one embodiment, $R_2$ is an alkyl group containing from about 3 to about 24, or from about 6 to about 20, or from about 6 to about 12 carbon atoms. In one embodiment alkyl groups are derived from one or more of the above polyalkenes. The alkyl groups may be derived from polymers of ethylene, propylene, 1-butene and isobutene, preferably propylene tetramer or trimer. Examples of $R_2$ groups include hexyl, heptyl, octyl, decyl, dodecyl, tripropenyl, tetrapropenyl, etc, Examples of $R_1$, $R_2$ and $R_3$ groups include propyl, isopropyl, butyl, sec-butyl, tert-butyl, heptyl, octyl, and nonyl. In another embodiment, each $R_1$ and $R_3$ are tertiary groups, such as tert-butyl or tert-amyl groups. The phenolic compounds may be prepared by various techniques, and in one embodiment, such phenols are prepared in stepwise manner by first preparing the para-substituted alkylphenol, and thereafter alkylating the para-substituted phenol in the 2- and/or 6-position as desired. When it is desired to prepare coupled phenols of the type presented by Formulae IVa and Va, the second step alkylation is conducted under conditions which result in the alkylation of only one of the positions ortho to the hydroxyl group. Examples of useful phenolic materials include: 2-t-butyl-4-heptylphenol; 2-t-butyl-4octylphenol; 2-t-butyl-4-dodecylphenol; 2,6-di-t-butyl-4-butylphenol; 2,6-di-t-butyl-4heptylphenol; 2,6-di-t-butyl-4-dodecylphenol; 2,6-di-t-butyl-tetrapropenylphenol; 2-methyl-6-di-t-butyl-4-heptylphenol; 2,6-di-t-butyl-tripropenylphenol; 2,4-dimethyl-6-t-butylphenol; 2,6-t-butyl-4ethylphenol; 4t-butylcatechol; 2,4-di-t-butyl-p-cresol; 2,6-di-t-butyl-4-methylphenol; and 2-methyl-6-di-t-butyl-4-dodecylphenol. Examples of the ortho coupled phenols include; 2,2'-bis(6-t-butyl-4-heptylphenol); 2,2'-bis (6-t-butyl-4-octylphenol); 2,6-bis-(1'-methylcyclohexyl)-4-methylphenol; and 2,2'-bis(6-t-butyl-4-dodecylphenol).

Alkylene-coupled phenolic compounds may be prepared from the phenols by reaction of the phenolic compound with an aldehyde, typically those containing from one to about eight carbon atoms, such as formaldehyde or acetaldehyde, aldehyde precursors, such as paraformaldehyde or trioxane, or a ketone, such as acetone. The alkylene-coupled phenols may be obtained by reacting from 0.3 to about 2 moles a phenol with 1 equivalent of an aldehyde or ketone. Procedures for coupling of phenolic compounds with aldehydes and ketones are known to those in the art. Examples of phenolic compounds include 2,2'-methylenebis(6-t-butyl4heptylphenol); 2,2'-methylenebis(6-t-butyl-4-octylphenyl); 2,2'-methylenebis(4-dodecyl-6-t-butylphenol); 2,2'-methylenebis(4-octyl-6-t-butylphenol); 2,2'-methylenebis(4-octylphenol); 2;2'-methylenebis(4-dodecylphenol); 2,2'-methylenebis(4-heptylphenol); 2,2'-methylenebis(6-t-butyl-4dodecylphenol); 2,2'-methylenebis(6-t-butyl-4tetrapropenylpheriol); and 2,2'-methylenebis(6-t-butyl-4-butyl phenol).

In another embodiment, the antioxidant (D) is a metal-free (or ashless) alkylphenol sulfide or sulfur coupled phenols. The alkylphenols from which the sulfides are prepared also may comprise phenols of the type discussed above and represented by Formula IIIa wherein R.sub.3 is hydrogen. For example, the alkylphenols which can be converted to alkylphenol sulfides include: 2-t-butyl-4-heptylphenol; 2-t-butyl-4-octylphenol; and 2-t-butyl-4-dodecylphenol; 2-t-butyl-4-tetrapropenylphenol. The term "alkylphenol sulfides" is meant to include di-(alkylphenol) monosulfides, disulfides, and polysulfides, as well as other products obtained by the reaction of the alkylphenol with sulfur monochloride, sulfur dichloride or elemental sulfur. One mole of phenol typically is reacted with about 0.5- 1.5 moles, or higher, of sulfur compound. For example, the alkylphenol sulfides are readily obtained by mixing, one mole of an alkylphenol and 0.5-2.0 moles of sulfur dichloride. The reaction mixture is usually maintained at about 100° C. for about 2-5 hours, after which time the resulting sulfide is dried and filtered. When elemental sulfur is used, temperatures from about 150-250° or higher are typically used. It is also desirable that the drying operation be conducted under nitrogen or a similar inert gas. A particularly useful alkylphenol sulfide is thio-bis(tetrapropenylphenate).

Suitable basic alkylphenol sulfides are disclosed, for example, in U.S. Pat. Nos. 7,372,116; 3,410,798; and 4,021,419, which are hereby incorporated by reference. These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or an aldehyde precursor, e.g., paraformaldehyde or trioxane. Alternatively the substituted phenol may be first reacted with formaldehyde or paraformaldehyde and thereafter reacted with sulfur or a sulfur halide to produce the desired alkylphenol sulfide.

In another embodiment, the antioxidant (D) is a dithiocarbamate antioxidant. The dithiocarbamate antioxidants include reaction products of a dithiocarbamic acid or salt and one or more of the above described unsaturated compounds, such as unsaturated amides, carboxylic acids, anhydrides, or esters, or ethers; alkylene-coupled dithiocarbamates; and bis (S-alkyldithiocarbamoyl) disulfides. In one embodiment, the dithiocarbamate compounds ashless, i.e. metal free. The dithiocarbamates are described above. In another embodiment, antioxidant is a sulfurized Diels-Alder adduct.

(C) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octylstearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(D) Demulsiflers: addition product of alkylphenol and ethyleneoxide, polyoxyethylene alkyl ether, and polyoxyethylene sorbitane ester.

(E) Extreme pressure agents (EP agents): sulfurized oils, diphenyl sulfide, methyl trichlorostearate, chlorinated naphthalene, benzyl iodide, fluoroalkylpolysiloxane, and lead naphthenate.

(F) Friction modifiers; fatty alcohol, fatty acid, amine, borated ester, and other esters (G) Multifunctional additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

(H) Viscosity Index improvers; polymethaerylate type polymers, ethylene-propylene copolymers, styrene-isoprene copolymers, hydrated styrene-isoprene copolymers, polyisobutylene, and dispersant type viscosity index improvers.

(I) Pour point depressants: polymethyl methacrylate.

(K) Foam Inhibitors: alkyl methacrylate polymers and dimethyl silicone polymers.

(L) Wear inhibitors: zinc dialkyldithiophosphate (Zn-DTP, primary alkyl type & secondary alkyl type),

EXAMPLES

The invention is further illustrated by the following examples, which are not to be considered as limitative of its scope. A further understanding of the invention can be had in the following nonlimiting Preparations and Examples. Wherein unless expressly stated in the contrary, all temperatures and temperatures ranges refer to the Centigrade system and the term "ambient" or "room temperature" refers to about 20 to 25° C. The term "percent or %" refers to weight percent, and the term "mole" or "moles" refers to gram moles. The term "equivalent" refers to a quantity of reagent equal in moles, to the moles of the preceding or succeeding reactant recited in that example in terms of finite moles or finite weight or volume. Where given, proton-magnetic resonance spectrum (p.m.r. or n.m.r) were determined at 300 mHz, signals are assigned as singlets(s), broad singlets (bs), doublets (d), double doublets (dd), triplets (t), double triplets (dt), quartets (q), and multiplets (m), and cps refers to cycles per second, Preparation of Component A1

N-(4-n-butylphenyl)-N-(4-nitrophenyl)amine

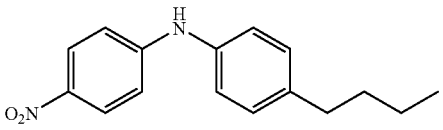

To a flask equipped with a magnetic stirrer, reflux condenser, and a nitrogen inlet was added 4-n-butylaniline (48.5 grams, 0.325 moles), 1-fluoro-4-nitrobenzene (15.3 grams, 0.108 moles) and anhydrous methyl sulfoxide (120 ml). The contents of the flask were heated at 100° C. for 3 days; cooled to room temperature; partitioned between diethyl ether (300 ml) and water (100 ml). The ether extract was washed with water (4×100 ml) followed by brine (2×50 ml). The ether extract was dried over anhydrous magnesium sulfate, filtered and concentrated m vacuo to yield a brown oily residue. The residue was re-crystallized from hexane (300 ml) to yield 18.4 grams of product as a yellow solid. $^1$H NMR ($CDCl_3$) δ 8.1(d, 2H), 7.2(d, 2H), 7.15(d, 2H), 6.9(d, 2H), 6.3(bs, 1H), 2.6(t 2H), 1.6(pent, 2H), 1.4(hextet, 2H), 0.9(t, 3H).

Preparation of Component A2

N-(4-n-hexylphenyl)-N-(4-nitrophenyl)amine

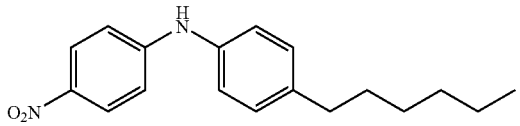

To a flask equipped with a magnetic stirrer, reflux condenser, and a nitrogen inlet was added 4-n-hexylaniline (49.1 grams, 0.283 moles), 1-fluoro-4-nitrobenzene (13.3 grams. 0.094 moles) and anhydrous methyl sulfoxide (80 ml). The contents of the flask were heated at 100° C. for 4 days; cooled to room temperature; partitioned between diethyl ether (300 ml) and water (100 ml). The ether extract was washed with water (4×100 ml) followed by brine (3×50 ml). The ether extract was dried over anhydrous magnesium sulfate, filtered and concentrated in vacuo to yield a brown liquid. The brown liquid was recrystalized from hexane (500 ml) to yield 15.0 grams of product as a yellow solid. $^1$H NMR ($CDCl_3$) δ 8.1(d, 2H), 7.2(d, 2H), 7.15(d, 2H),6.9(d, 2H), 6.3(bs, 1H), 2.6(t, 2H), 1.6(pent, 2H), 1.2-1.4(m, 6H), 0.9(t, 3H).

Preparation of Component A3

N'-(4-nitrophenyl)-N,N'-di-n-hexylbenzene-1,4-diamine

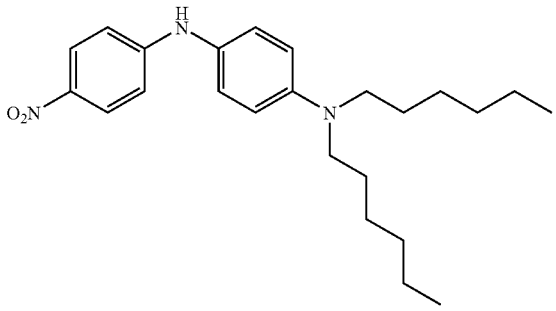

Step 1—Preparation of N,N-di-n-hexyl-N-(4-nitrophenyl)amine

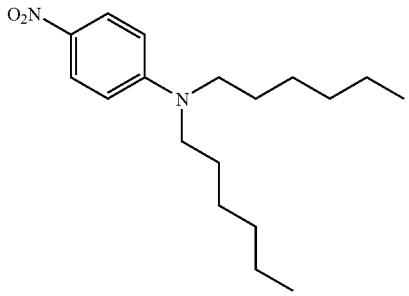

To a flask equipped with a magnetic stirrer, reflux condenser, and a nitrogen inlet was added di-n-hexylamine (14.1 grams, 0.3 moles), 1-fluoro-4-nitrobenzene (14.1 grams, 0.1 moles) and anhydrous methyl sulfoxide (40 ml). The contents of the flask were heated at 100° C. for 20 hours; cooled to room temperature; partitioned between diethyl ether (300 ml) and water (100 ml); filtered. The ether layer was dried over anhydrous magnesium sulfate, filtered and concentrated in vacuo to yield a yellow oil containing excess dihexylamine. The yellow oil was purified by passing through a short column of silica gel and elating with hexane (300 ml) to yield 25.0 grams of product as a yellow oil. $^1$H NMR ($CDCl_3$) δ 8.1(d, 2H), 6.5(d, 2H), 3.3 5(t, 4H), 1.6(pent, 4H), 1.2-1.4(m, 12H), 0.9(t, 6H).

Step 2—Preparation of N,N-di-n-hexylbenzene-1,4-diamine

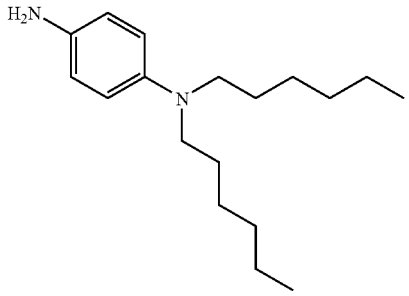

A solution of 25.0 grams of N,N-di-n-hexyl-N-(4-nitrophenyl)amine in 100 ml of ethyl acetate containing 3.02 grams of 10% palladium on activated charcoal was hydrogenated at 40 psi for 1.5 hours. The solution was filtered and concentrated in vacuo to yield 23.2 grams of product as a colorless oil. $^1$H NMR ($CDCl_3$) δ 6.4(AB quartet, 4H), 3.3 (bs, 2H), 3.15(t, 4H), 1.5(pent, 4H), 1.2-1.4(m, 12H), 0.9(t, 6H).

Step 3—Preparation of N'-(4-nitrophenyl)-N,N'-di-n-hexylbenzene-1,4-diamine

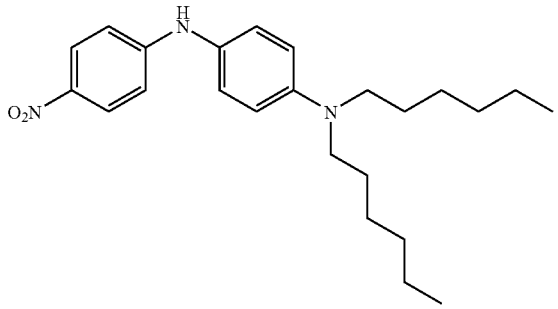

To a flask equipped with a magnetic stirrer, reflux condenser, and a nitrogen inlet was added N,N-di-n-hexylbenzene1,4-diamine (22.3 grams 0.09 moles), 1-fluoro-4-nitrobenzene (4.3 grams. 0.03 moles) and anhydrous methyl sulfoxide (40 ml). The contents of the flask were heated at 100° C. for 3 days; cooled to room temperature; partitioned between ethyl acetate (200 ml) and water (100 ml). The ethyl acetate extract was washed with water (4×100 ml) followed by brine (50 ml). The ethyl acetate extract was dried over anhydrous magnesium sulfate, filtered and concentrated in vacuo to yield a dark brown oil containing excess N,N-di-n-hexyl-N-(4-nitrophenyl)amine. The dark brown oil was chromatographed on silica gel, eluting with hexane/ethyl acetate gradient to afford 11.8 grams of the desired product as a dark purple color oil. $^1$H NMR (DMSO-$d_4$) δ 8.95(bs, 1H), 8.0(d, 2H), 7.0(d, 2H), 6.8(d, 2H), 6.6(d, 2M), 3.25(t, 4H), 1.5(pent, 4H), 1.2-1.4(m, 12H), 0.9(t, 6H), Preparation of Comparative Component A4

2-ethylhexyl 4-[(4-nitrophenyl)amino]benzoate

Step 1—Preparation 2-ethylhexyl 4-nitrobenzoate

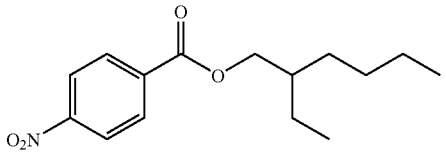

To a flask equipped with a magnetic stirrer, reflux condenser, and a nitrogen inlet was added 4-nitrobenzoyl chloride (53.0 grams, 0.285 moles), 2-ethylhexanol (28.6 grams, 0.22 moles), triethyl amine (30.2 grams, 0.30 moles) and 4-dimethylaminopyridine (6.98 grams, 0.0.57 moles) and anhydrous toluene (420 ml). The contents of the flask were heated at reflux for 16 hours; cooled to room temperature. It was diluted with diethyl ether (300 ml). The ether extract was washed with diluted HCl(1wt %, 3×100 ml), followed with a saturated sodium bicarbonate solution (3×100 ml), brine (3×100 ml), dried over anhydrous magnesium sulfate, filtered and concentrated in vacuo to yield 57.2 grams of crude product as a yellow oil. $^1$H NMR ($CDCl_3$) δ 8.3(d, 2H), 8.2(d, 2H), 4.3(d, 2H), 1.75(heptet, 1H), 1.2-1.6(m, 8H), 0.8-1.0(m, 6H).

Step 2—Preparation of 2-ethylhexyl 4-aminobenzoate

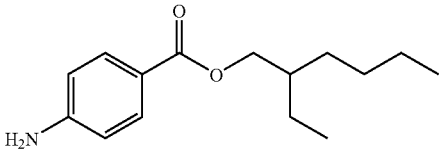

A solution of 2-ethylhexyl 4-aminobenzoate (20.0 grams, 0.072 moles) in 100 ml of ethyl acetate containing 0.36 grams of 10% palladium on activated charcoal was hydrogenated at 50 psi for 2 hours. The solution was filtered and concentrated in vacuo to yield 17.3 grams of product as a yellow solid. $^1$H NMR ($CDCl_3$) δ 7.85(d, 2H), 6.65(d, 2H), 4.75(bs, 2H), 4.15(d, 2H), 1.7(heptet, 1H), 1.2-1.5(m, 8H), 0.8-1.0(m, 6H).

Step 3—Preparation of 2-ethylhexyl 4-[(4-nitrophenyl)amino]benzoate

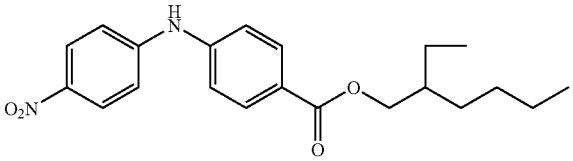

To a flask equipped with a magnetic stirrer, reflux condenser, and nitrogen inlet was added 2-ethylhexyl 4-aminobenzoate (8.38 grams, 30.0 mmoles), 1-bromo-4-nitrobenzofuran (5.05 grams, 25.0 mmoles), tris (dibenzylideneacetone)dipalladium (0) (0.57 grams, 0.625 mmoles), 1,1'-bis(diphenylphosphino)-ferrocene (1.04 grams, 1.88 mmoles), sodium tert-butoxide (3.6 grams, 37.5 mmoles) and anhydrous toluene (80 mL). The contents of the flask were heated to 80° C. for three days; cooled to room temperature; and filtered through a pad of silica gel. The silica gel pad was then eluted with dichloromethane (200 ml) and ethyl acetate (200 ml). The combined organic layers were concentrated in vacuo to yield a yellow solid (11.0 grams). It was chromatographed on silica gel, eluting with a hexane/ethyl acetate gradient followed by recrystallization from a mixture of hexane and ethyl acetate to afford 3.5 grams of the desired product and as a pale yellow powdery solid. $^1$H NMR ($CDCl_3$) δ 8.15 (d, 2H), 8.05 (d, 2H), 7.21 (d, 2H), 7.1(d, 2H), 6.7 (bs, 1H), 4.22(d, 2H), 1.7(heptet, 1H), 1.2-1.6(m, 8H), 0.8-1.0 (m, 6H).

Preparation of Comparative Component A5

N-{4-[(2-ethylhexyl)oxy]phenyl}-N-(4-nitrophenyl)amine

Step 1—Preparation of 1-[(2-ethylhexyl)oxy]-4-nitrobenzene

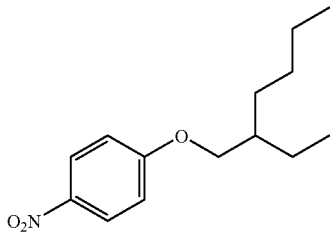

To a flask equipped with a magnetic stirrer, reflux condenser, and a nitrogen inlet was added 4-nitrophenol (27.14 grams, 0.195 moles), potassium carbonate (51.13 grams, 0.370 moles), 2-ethylhexyl iodide (45.63, 0.185 moles) in 1-methyl-pyrrolidin-2-one(180 ml). The contents of the flask were heated at 100° C. for 3 hours; cooled to room temperature; partitioned between ethyl acetate and water. The aqueous layer was extracted with ethyl acetate (3×100 ml). The ethyl acetate extract was washed with a 1 N sodium hydroxide solution (4×75 ml), brine (3×100 ml), dried over anhydrous magnesium sulfate, filtered and concentrated in vacuo to yield 29.9 grams of crude product as a yellow oil. Excess 2-ethylhexyl iodide was removed from the product using Kugelrohr distillation apparatus to afford 20 grams of pure product as a yellow oil. $^1$H NMR ($CDCl_3$) δ 8.2(d, 2H), 6.95(d, 2H), 3.95(d, 2H), 1.75(heptet, 1H), 1.2-1.6(m, 8H), 0.85-1.0(m, 6H).

Step 2—Preparation of 4-[(2-ethylhexyl)oxy]aniline

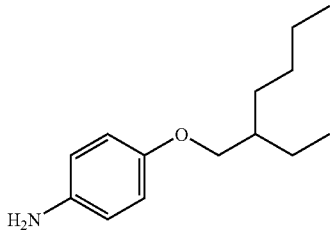

A solution of 1-[(2-ethylexyl)oxy]-4-nitrobenzene (18.5 grams, 0.074 moles) in 80 ml of ethyl acetate containing; 1.86 grams of 10% palladium on activated charcoal was hydrogenated at 50 psi for 8 hours. The solution was filtered and concentrated in vacuo to yield 10.0 grams of product as a dark yellow oil. $^1$H NMR ($CDCl_3$) δ 6.75(d, 2H), 6.6(d, 2H), 3.75(d, 2H), 3.4(bs, 2H), 1.7 (heptet, 1H), 1.2-1.6(m, 8H), 0.8-1.0(m, 6H).

Step 3—Preparation of N-{4-[(2-ethylhexyl)oxy]phenyl}-N-(4-nitrophenyl)amine

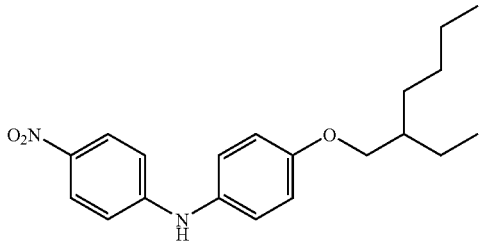

To a flask equipped with a magnetic stirrer, reflux condenser, and a nitrogen inlet was added 4-[(2-ethyl-hexyl)oxy] aniline (10.0 grams, 0,045 moles), 1-fluoro-4-nirobenzene (2.13 grams, 0.015 moles) and anhydrous methyl sulfoxide (40ml). The contents of the flask were heated at 100° C. for 2 days; cooled to room temperature; partitioned between diethyl ether (300 ml) and wafer (100 ml). The ether extract was washed with brine (2×50 ml). The ether extract was dried over anhydrous magnesium sulfate, filtered and concentrated in vacuo to yield a dark brown oil. It was chromatographed on silica gel, eluting with hexane/ethyl acetate gradient to afford 4.1 grams of the desired product as a dark brown color oil. $^1$H NMR ($CDCl_3$) δ 8.05(d, 2H), 7.1(d, 2H), 6.9(d, 2H), 6.75(d, 2H), 6.2(bs, 1H), 3.85(d, 2H), 1.75 (heptet, 1H), 1.2-1.7(m, 8H), 0.8-1.0(m, 6H).

B1—Preparation of Phenyl-(1,2,3,4-tetrahydro-quinolin-6-yl)-amine

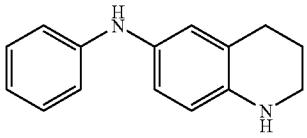

A solution of 20.4 grams of 6-anilinoquinoline (prepared as described in Buu-Hoi, Royer and Hubert-Habart, J. Chem. Soc. 1956, 2048-2051) in 400 mL of acetic acid containing 1.3 grams of platinum(IV) oxide was hydrogenated at 30 psi for 4.2 hours on a Parr low-pressure hydrogenator. The solution was filtered; and the filtrate was neutralized with 6N aqueous sodium hydroxide. The aqueous phase was extracted three times with dichloromethane. The combined dichloromethane layers were washed with 6N aqueous sodium hydroxide followed by brine. The dichloromethane layer was dried over anhydrous magnesium sulfate, filtered and concentrated in vacuo to yield 20.4 grams of a dark residue. The dark residue was recrystallized from 95% ethandl to yield 15.2 grams of the desired product as a grey solid, 1H NMR (CD Cl3 ) □ 7.2 (m, 2H), 6.8 (m, 4H), 6.45 (d, 1H), 5.35 (bs, 1H), 3.4 (bs, 1H), 3.25 (t, 2H), 2.75 (t, 2H), 1.95 (p, 2H).

B2—Irganox® L57 (diphenylamine alkylated with 2,4,4-trimethylpentene) Available commercially from Ciba-Geigy B3-4-(2-octylamino)diphenylamine Available from TCI America B4 - Preparation of N-(4-tert-butylphenyl)-1,2,3,4-tetrahydroquinolin-8-amine

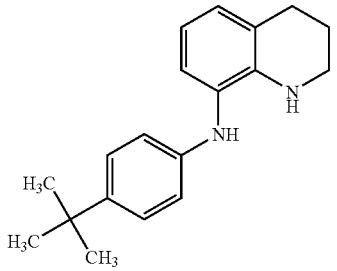

To a flask equipped with a magnetic stirrer, reflux condenser, and nitrogen inlet was added 8-aminoquinoline (14.4 grams, 0.10 moles), 4-tert-butyl bromobenzene (21.3 grams, 0.10 moles), tris(dibenzylideneacetone)dipalladium (0) (1.8 grams, 0.002 moles), rac-2,2'-bis(diphenylphosphino)-1,1'-binapthyl (2.5 grams, 0.004 moles), sodium tert-butoxide (19.4 grams, 0.20 moles) and anhydrous toluene (150 mL). The contents of the flask were refluxed for four days; cooled to room temperature; and filtered through a pad of silica gel. The silica gel pad was then eluted with dichloromethane (240 mL). The combined organic layers were concentrated in vacuo to yield a dark blue solid. The solid was chromatographed on silica gel, eluting with hexane/ethyl acetate (20:1) to afford 23 grams of the desired product as a yellow solid. $^1$H NMR ($CDCl_3$) δ 8.8 (m, 1H), 8.2 (bs, 1H), 8.1 (d, 1H), 7.1-7.5 (m, 9H), 1.35 (s, 9H).

A solution of 2.46 grams of N-(4-tert-butylphenyl)quinolin-8-amine prepared above in 100 mL of acetic acid containing 0.15 grams of platinum(IV) oxide was hydrogenated at 45 psi for 1.5 hours on a Parr low-pressure hydrogenator. The solution was filtered through diatomaceous earth; concentrated in vacuo; and neutralized with 3N aqueous sodium hydroxide. The aqueous phase was diluted with water and extracted three times with ethyl acetate. The combined ethyl acetate layers were washed with brine; dried over anhydrous magnesium sulfate, filtered and concentrated in vacuo to yield 2.5 grams of dark blue oil. The oil was chromatographed on silica gel, eluting with hexane/ethyl acetate (20:1) to afford 2.0 grams of the desired product as a yellow oil. $^1$H NMR ($CDCl_3$ ) δ 7.2 (d, 2H), 6.5-6.95 (m, 5H), 4.95 (bs, 1H), 33 (t, 2H), 2.8 (t, 2H), 1.9 (p, 2H), 1.3 (s, 9H).

B5—Preparation of N-(4-butylphenyl)-1,2,3,4-tetrahydroquinolin-8-amine

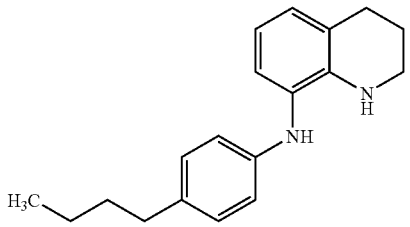

To a flask equipped with a magnetic stirrer, reflux condenser, and nitrogen inlet was added 8-hydroxyquinoline (20.0 grams, 0.14 moles), 4-butyl aniline (24.0 grams, 0.16 moles) and iodine (0.52 grams, 2.0 mmoles). The-contents of the flask were refluxed for eight days; cooled to room temperature; and diluted with toluene. The toluene solution was filtered through diatomaceous earth and further diluted with dichloromethane. The solution was washed with 5% aqueous sodium hydroxide three times and water three times. The organic layer was dried over magnesium sulfate, filtered and concentrated in vacuo to yield a dark brown oil. The oil was chromatographed on silica gel, eluting with hexane/ethyl acetate (10:1) to afford 3.7 grams a brown oil.

The oil in 70 mL of acetic acid containing 0.22 grams of platinum (IV) oxide was hydrogenated at 35 psi for 4.5 hours on a Parr low-pressure hydrogenator. The solution was filtered; and the filtrate was neutralized with 6N aqueous sodium hydroxide. The aqueous phase was extracted three times with dichloromethane. The combined dichloromethane layers were washed with 6N aqueous sodium hydroxide followed by brine. The dichloromethane layer was dried over anhydrous magnesium sulfate, filtered and concentrated in vacuo to yield 3.9 grams of a dark brown oil. The oil was chromatographed on silica gel, eluting with a hexane/ethyl acetate gradient to afford 2.1 grams of the desired product as a yellow oil $^1$H NMR ($CDCl_3$) δ 7.05 (d, 2H), 6.95 (d, 1H), 6.80 (d, 1H), 6.70 (d, 2H), 6.6 (t,1H), 4.95 (bs, 1H), 4:05 (bs, 1H), 3.3 (t, 2H), 2,8 (t, 2H), 2.5 (t, 2H), 1.95 (p, 2H), 1.55 (p, 2H), 1.35(h, 2H), 0.95 (t, 3H).

Performance Examples

Oxidation studies of the products of selected Examples were carried out in a bulk oil oxidation bench test as described by E. S. Yamaguphi et al. in Tribology Transactions, Vol. 42(4), 895-901 (1999). In this test the rate of oxygen uptake at constant pressure by a given weight of oil was monitored. The time required (induction time) for rapid oxygen uptake per 25 grams of sample was measured at 171oC under 1.0 atmosphere of oxygen pressure. The sample was stirred at 1000 revolutions per minute. The results are reported, however, as time for rapid oxygen uptake per 100 grams of sample. The oil contained a catalyst added as oil soluble naphthenates to provide 26 ppm iron, 45 ppm copper, 512 ppm lead, 2.3 ppm manganese, and 24 ppm tin.

Performance Examples

A base line formulation was prepared to evaluate the performance of the mixture of; component a) a nitrodiphenylamine of formula A1 through A5; and component b) a diarylamine of formula B1, B2 and B3, in the oxidator bench test. The base line formulation—Formulation A, contained in a Group 2+ base oil. 12.5 mmoles/kg dialkyl zinc dithiophosphate, 5.0% polyisobutenyl succinimide, 35.0 mmoles/kg overbased calcium sulfonate detergent, 15.0 mmole/kg calcium phenate detergent, 0.25 weight percent of a molybdenum containing polyisobutenyl succinimide prepared as described in U.S. Pat. No. 6,962,896 to Ruhe (this polyisobutenyl succinimide contains 5.5 weight percent molybdenum) and 0.3% V.I, improver. The Formulation A baseline was tested in the bulk oil oxidation bench test above and resulted in a value of 10 hours to rapid $O_2$ uptake.

Notable in the performance examples is that the nitrodiphenylamine by itself imparted no improvement in the oxidator bench test over the baseline, for example look to the comparison of performance example a to performance example b in Example 1-4 and Comparative Examples.

Example 1

| | Mixture Top Treated to Formulation A | | |
|---|---|---|---|
| Performance Example | Component A1 concentration (weight percent) | Component B2 concentration (weight percent) | Results (Hours to rapid $O_2$ uptake) |
| a | 0 | 0 | 10.0 |
| b | 1.0 | 0.0 | 10.0 |
| c | 0 | 0.5 | 23.5 |
| d | 0.50 | 0.5 | 27.0 |
| e | 0.75 | 0.5 | 27.5 |
| f | 1.00 | 0.5 | 51.5 |

Example 1 illustrates improvement in the oxidative stability of lubricating oil by the addition of 0.5-1.00 wt % of an alkylated nitrodiphenylamine (Component A1) to a 0.5 wt % of an alkylated diphenylamine (Component B2). The alkylated nitrodiphenylamine (Example 1b) at 1.00 wt % by Itself shows no Improvement to the baseline formulation (Example 1a). The alkylated diphenylamine (Example 1c) improves the oxidative stability. Combinations of alkylated nitrodiphenylamine and alkylated diphenylamine show further improvement in oxidative stability (Examples 1 d-f).

Example 2

| | Mixture Top Treated to Formulation A | | |
|---|---|---|---|
| Performance Example | Component A1 concentration (weight percent) | Component B1 concentration (weight percent) | Results (Hours to rapid $O_2$ uptake) |
| a | 0 | 0 | 10.0 |
| b | 1.0 | 0.0 | 10.0 |
| c | 0 | 0.5 | 36.0 |
| d | 0.16 | 0.5 | 39.0 |
| e | 0.33 | 0.5 | 50.0 |
| f | 0.50 | 0.5 | 54.0 |
| g | 0.75 | 0.5 | 75.0 |
| h | 1.00 | 0.5 | 106.0 |

Example 2 Illustrates improvement in the oxidative stability of lubricating oil by the addition of 0.16-1.00 wt % of an alkylated nitrodiphenylamine (Component A1) to a 0.5 wt % of a heterocyclic amino diphenylamine (Component B1). The alkylated nitrodiphenylamine (Example 2b) at 1.00 wt % by itself shows no improvement to the baseline formulation (Example 2a). The heterocyclic amino diphenylamine (Example 2c) improves the oxidative stability. Combinations of alkylated nitrodiphenylamine and heterocyclic amino diphenylamine show further improvement in oxidative stability (Examples 2 d-h).

Example 3

| | Mixture Top Treated to Formulation A | | |
|---|---|---|---|
| Performance Example | Component A1 concentration (weight percent) | Component B3 concentration (weight percent) | Results (Hours to rapid $O_2$ uptake) |
| a | 0 | 0 | 10.0 |
| b | 1.0 | 0.0 | 10.0 |
| c | 0 | 0.5 | 32.5 |
| d | 0.75 | 0.5 | 44.0 |
| e | 1.00 | 0.5 | 53.0 |
| f | 1.50 | 0.5 | 95.5 |

Example 3 illustrates improvement in the oxidative stability of lubricating oil by the addition of 0.75-4.50 wt % of an alkylated nitrodiphenylamine (Component A1) to a 0.5 wt % of an amino diphenylamine (Component B3). The alkylated nitrodiphenylamine (Example 3b) at 1.00 wt % by itself shows no improvement to the baseline formulation (Example 3a). The amino diphenylamine (Example 3c) improves the oxidative stability. Combinations of alkylated nitrodiphenylamine and amino diphenylamine show further improvement in oxidative stability (Examples 3d-f).

Example 4

| | Mixture Top Treated to Formulation A | | |
|---|---|---|---|
| Performance Example | Component A3 concentration (weight percent) | Component B3 concentration (weight percent) | Results (Hours to rapid $O_2$ uptake) |
| a | 0 | 0 | 10.0 |
| b | 1.0 | 0.0 | 10.0 |
| c | 0 | 0.5 | 33.5 |
| d | 0.75 | 0.5 | 58.0 |
| e | 1.00 | 0.5 | 57.5 |
| f | 1.50 | 0.5 | 78.0 |

Example 4 illustrates improvement in the oxidative stability of lubricating oil by the addition of 0.75-1.50 wt % of an alkylamino nitrodiphenylamine (Component A3) to a 0.5 wt % of an amino diphenylamine (Component B3). The alkylamino nitrodiphenylamine (Example 4b) at 1.00 wt % by itself shows no improvement to the baseline formulation (Example 4a). The amino diphenylamine (Example 4c) improves the oxidative stability. Combinations of alkylated nitrodiphenylamine and amino diphenylamine show further improvement in oxidative stability (Examples 4d-f).

Example 5

| Performance Example | Mixture Top Treated to Formulation A: Component A3 Concentration (Weight percent) | Component B3 Concentration (weight percent) | Component C Concentration (weight percent) | Results (Hours to rapid $O_2$ uptake) |
|---|---|---|---|---|
| 5.1 | 0 | 0 | — | 10.0 |
| 5.2 | 0.75 | 0.5 | — | 58.0 |
| 5.3 | 0.75 | 0.5 | 0.375 | 62 |
| 5.4 | 1.0 | 0.5 | 0.50 | 69.5 |
| 5.5 | 1.5 | 0.5 | 0.75 | 86.5 |

Component C is added weight percent of a molybdenum containing polyisobutenyl succinimide prepared as described in U.S. Pat. No. 6,962,896 to Ruhe (this polyisobutenyl succinimide contains 5.5 weight percent molybdenum) to the baseline formulation. Thus for example 5.1 and 5.2 employed the baseline 0.25 wt % of Component C, while 5.3-5.5 were top treated with the amount disclosed in the column. Examples 5.3-5.4 demonstrate an improvement in the oxidative stability, Comparative Example 1

| Performance Example | Mixture Top Treated to Formulation A: Component A4 concentration (weight percent) | Component B3 concentration (weight percent) | Results (Hours to rapid $O_2$ uptake) |
|---|---|---|---|
| a | 0 | 0 | 10.0 |
| b | 1.0 | 0.0 | 10.0 |
| c | 0 | 0.5 | 33.5 |
| d | 0.75 | 0.5 | 32.0 |
| e | 1.00 | 0.5 | 33.0 |
| f | 1.50 | 0.5 | 19.5 |

Comparative Example 2

| Performance Example | Mixture Top Treated to Formulation A: Component A5 concentration (weight percent) | Component B3 concentration (weight percent) | Results (Hours to rapid $O_2$ uptake) |
|---|---|---|---|
| a | 0 | 0 | 10.0 |
| b | 1.0 | 0.0 | 10.0 |
| c | 0 | 0.5 | 33.5 |
| d | 0.75 | 0.5 | 33.0 |
| e | 1.00 | 0.5 | 35.5 |
| f | 1.50 | 0.5 | 38.5 |

Comparative Examples 1 and 2 demonstrate that alkoxy substituted nitrodiphenylamines (Comparative Example 2) and ester substituted nitrodiphenylamines (Comparative Example 1) combinations with amino diphenylamines do not show further improvements in oxidative stability of lubricating oils. This is contrary to alkoxy groups being attached to diphenylamines as disclosed in Koshkin, L. V.; Rodionova, N. M.; Zyuzina, L, N.; Yablonski, O. P.; *Izvestiya Vysshikh Uchebnykh Zavedenii, Khimiya* i *Khimicheskaya Tekhnologiya* (1985), 28(8), 97-100.

What is claimed is:

1. A composition comprising a lubricating oil and an oil soluble synergistic mixture of antioxidants, said mixture comprising:

a) from 0.1 to 10 weight percent of a first antioxidant according to formula I:

Formula I

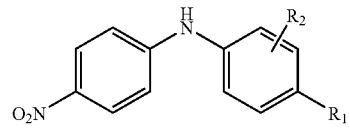

wherein $R_1$ is selected from the group consisting of alkyl from 3 to 24 carbon atoms, —NHR, —NRR where R is independently selected alkyl from 1 to 18 carbon atoms; $R_2$ is hydrogen or alkyl from 1 to 20 carbon atoms; and b) from 0.1 to 5 weight percent of a second antioxidant selected from the formula Formula II

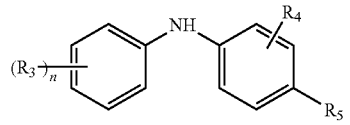

wherein $R_3$ and $R_4$ are each independently hydrogen or alkyl from 1 to 20 carbon atoms; n is an integer from 1 to 3; $R_5$ is selected from the group consisting of branched and straight chain hydrocarbyl radicals having from 3 to 24 carbon atoms selected from alkyl, alkoxy, aralkyl or alkaryl, or —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a live- or six-membered heterocyclic ring.

2. The composition according to claim 1, wherein the ratio of component a) to component b) is from about 1.25:1 to about 5:1.

3. The composition according to claim 2, wherein the total weight percent of the mixture of antioxidants in the composition is less than 5 weight percent.

4. The composition according to claim 3, wherein the total weight percent of the mixture of antioxidants in the composition is less than 2 weight percent.

5. The composition according to claim 1, wherein in component a): $R_2$ is hydrogen.

6. The composition according to claim 5 wherein $R_1$ is alkyl front 4 to 18 carbon atoms.

7. The composition according to claim 5, wherein $R_1$ is —NHR or —NRR wherein R is an independently selected alkyl group from 3 to 12 carbon atoms.

8. The composition according to claim 1, wherein in component b): $R_5$ is selected from alkyl from 3 to 24 carbon atoms or —$NHR_6$, —$NR_6R_7$ where $R_6$ and $R_7$ are independently selected alkyl from 1 to 18 carbon atoms.

9. The composition according to claim 8, wherein in component b): $R_5$ is selected from alkyl from 4 to 18 carbon atoms.

10. The composition according to claim 1, wherein component b) is selected from the group consisting of monoalkylated diphenylamine, dialkylated diphenylamine, trialkylated diphenylamine, and mixtures thereof.

11. The composition according to claim 10, wherein component b) is selected from the group consisting of butyldiphenylamine, di-butyldiphenylamine, octytdiphenylamine, di-octyldiphenylamine, nonyldiphenylamine, di-nonyldiphsnylamine, t-butyl-t-octyldiphenylamine, and mixtures thereof.

12. The composition according, claim 1, wherein in component b) $R_5$ is selected from —$NHR_6$, —$NR_6R_7$ where $R_6$ and $R_7$ are independently selected alkyl from 1 to 18 carbon atoms.

13. The composition according to claim 12, wherein in component b) $R_6$ and $R_7$ are independently selected alkyl from 6 to 12 carbon atoms.

14. The composition according to claim 1, wherein in component b) $R_5$ is selected from —$NHR_6$, —$NR_6R_7$ where $R_6$ and $R_7$ are independently selected alkyl from 1 to 18 carbon atoms, or when $R_4$ is positioned adjacent to $R_5$ then $R_6$ together with $R_4$ can form a five- or six-membered heterocyclic ring.

15. The composition according to claim 14, wherein $R_4$ is positioned adjacent to $R_5$ and $R_6$ together with $R_4$ form a five- or six-membered heterocyclic ring.

16. The composition according to claim 15, wherein $R_4$ is positioned adjacent to $R_5$ and $R_6$ together with $R_4$ form six-membered heterocyclic ring.

17. The composition according to claim 1, further comprising component c) an oil soluble molybdenum compound.

18. The composition according to claim 17, wherein component c) is an unsulfurized or sulfurized oxymolybdenum containing composition prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex.

19. The composition according to claim 10, wherein the basic nitrogen compound is a succinimide.

20. The composition according to claim 1, further comprising an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides.

21. The composition according to claim 20, wherein said phosphorus esters are selected from the group consisting of phosphates, phosphonates, phosphinates, phosphine oxides, phosphites, phosphorites, phosphinites, and phosphines.

22. The composition according to claim 20, wherein the oil-soluble, phosphorus-containing, anti-wear compound is a metal dithiophosphate.

23. The composition according to claim 22, wherein the metal dithiophosphate is a zinc dialkyldithiophosphate.

24. The composition according to claim 1, further comprising supplemental antioxidant selected from the group consisting of hindered phenols, hindered bisphenols, sulfurized phenols, sulfurized olefins, alkyl sulfides, polysulfides, dialkyl dithiocarbamates and phenothiazines.

* * * * *